United States Patent [19]

Müller Hans

[11] 4,221,373

[45] Sep. 9, 1980

[54] APPARATUS FOR FOLDING PAPER SHEETS OR THE LIKE

[75] Inventor: Müller Hans, Zofingen, Switzerland

[73] Assignee: GRAPHA-Holding AG, Hergiswil, Switzerland

[21] Appl. No.: 888,199

[22] Filed: Mar. 20, 1978

[30] Foreign Application Priority Data

Mar. 18, 1977 [CH] Switzerland ..... 3412/77

[51] Int. Cl.[2] ..... B65H 45/22

[52] U.S. Cl. ..... 270/86; 270/54

[58] Field of Search ..... 270/54, 61 R, 86–94

[56] References Cited

U.S. PATENT DOCUMENTS

| | | | |
|---|---|---|---|
| 3,297,315 | 1/1967 | Kunz | 270/86 |
| 3,534,953 | 10/1970 | Appleby | 270/86 |
| 3,931,963 | 1/1976 | Bewersdorf | 270/86 |
| 3,961,783 | 6/1976 | Beaudoin | 270/86 |

*Primary Examiner*—Edgar S. Burr
*Assistant Examiner*—A. Heinz
*Attorney, Agent, or Firm*—Peter K. Kontler

[57] ABSTRACT

Paper sheets which are creased during transport from a magazine to a folding station are delivered between the outer side of a straight reach of an elastic belt conveyor and a row of folding rollers whose radially outwardly tapering peripheral portions extend into a groove in the outer side of the conveyor whereby the rollers fold the sheets along the creases. The straight reach of the conveyor is propped from the inside by a set of rollers which are adjustable toward and away from the row of folding rollers to account for different thicknesses, stiffnesses and/or other characteristics of the sheets. The taper of peripheral portions of successive folding rollers increases in the direction of transport of sheets.

6 Claims, 3 Drawing Figures

FIG. 1
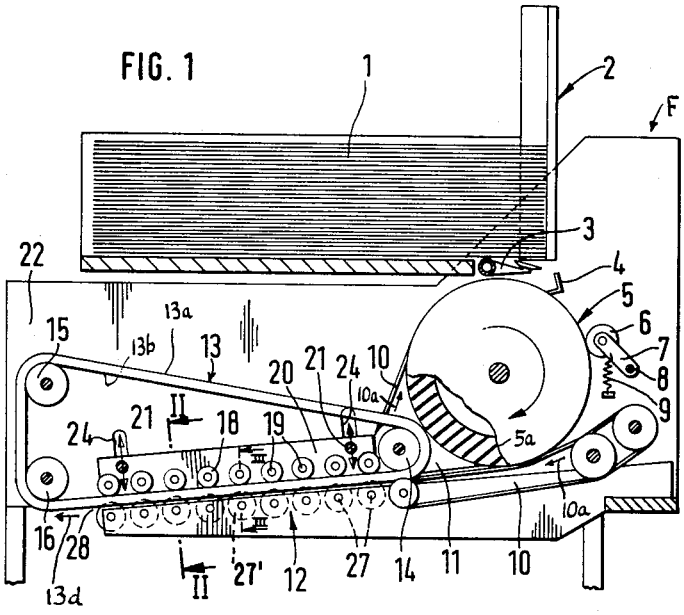
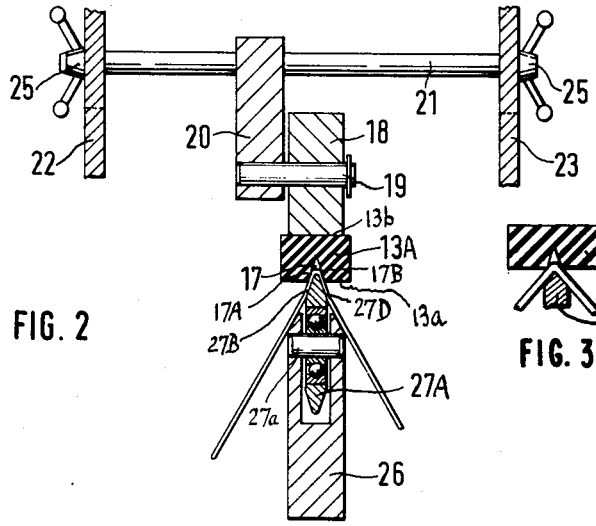
FIG. 2
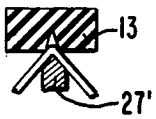
FIG. 3

APPARATUS FOR FOLDING PAPER SHEETS OR THE LIKE

BACKGROUND OF THE INVENTION

The present invention relates to improvements in apparatus for folding paper sheets or the like. More particularly, the invention relates to improvements in apparatus of the type wherein successive sheets are folded by a wedge-like folding device which extends into a complementary groove of a conveyor for transport of successive sheets between the conveyor and the folding device.

German Offenlegungsschrift No. 2,450,113 discloses a sheet folding apparatus wherein the outer side of an endless conveyor is formed with a longitudinally extending groove which moves past a wedge-like male folding member. The sheets to be folded are placed onto or are otherwise caused to adhere to the outer side of the conveyor so that each sheet is folded during transport past the male folding member. The apparatus which is disclosed in the aforementioned Offenlegungsschrift further comprises a magazine for a stack of unfolded sheets and a feeding mechanism which delivers successive sheets of the stack to the grooved conveyor. Prior to delivering a sheet to the grooved conveyor, the feeding mechanism provides such sheet with a crease to facilitate folding of successive sheets during travel past the male folding member. The conveyor is a first endless chain conveyor which carries a series of grooved matrices and includes an elongated straight stretch or reach for transport of successive matrices (in a common plane) past the male folding member. The sheets to be folded are supported by or attracted to the exposed sides of the matrices. The male folding member is a composite member including a row of wedges which are secured to a second endless chain conveyor. A stretch of the second chain conveyor is parallel to the aforementioned stretch of the first chain conveyor, and successive wedges of the male folding member travel in the same direction as the matrices on the first chain conveyor. As a rule, the matrices cooperate with the wedges of the male folding member to effect a partial folding of successive sheets; final folding takes place during transport of partially folded sheets between one or more pairs of folding or squeezing rollers.

A drawback of the just described apparatus is that the aforementioned straight stretches of the chain conveyors are not supported or propped from within. Therefore, and especially if the apparatus is operated at a high speed, the chain conveyors are likely to vibrate which entails undesirable and often pronounced shifting of sheets, especially of relatively thin sheets. Consequently, the line along which the wedges of the second chain conveyor fold the sheets during travel of sheets with the straight stretch of the first chain conveyor; in most instances, does not coincide with the line along which the sheet is creased during delivery from the magazine to the first chain conveyor.

OBJECTS AND SUMMARY OF THE INVENTION

An object of the invention is to provide a folding apparatus which is constructed and assembled in such a way that the sheets are not likely to change their positions during transport through the folding station.

Another object of the invention is to provide a folding apparatus which can be readily adjusted to insure proper treatment of thicker, thinner, stiffer, softer, high-quality or low-quality sheets, and wherein such adjustments can be carried out in a time-saving manner without necessitating resort to special tools.

Another object of the invention is to provide an apparatus wherein the folding of successive sheets to their final form can be completed in a small area and in fewer stages than in heretofore known folding apparatus.

A further object of the invention is to provide a folding apparatus wherein the folding of sheets takes place gradually and the instrumentalities which effect such folding are simpler and less expensive than in heretofore known apparatus.

The invention is embodied in an apparatus for folding sheets which consist of paper or the like. The apparatus comprises a frame, a preferably elastic driven endless conveyor mounted in the frame and having in its outer side an endless V-shaped groove, a back support (preferably including a series of idler rollers) adjacent to the inner side of a portion of the endless conveyor, first holder means for the back support, at least one male folding member adjacent to the outer side of the conveyor and including a wedge-like portion extending into the groove opposite the back support, second holder means for the folding member, means for adjustably securing at least one of the holder means (preferably the first holder means) to the frame for movement toward and away from the other holder means between a plurality of positions and including means for fixedly retaining the one holder means in a selected position, and means for feeding sheets seriatim between the outer side of the conveyor and the folding member whereby the folding member causes portions of the sheets to penetrate into the groove and to be folded as a result of such penetration. The apparatus preferably further comprises means for creasing the sheets ahead of the conveyor, and the feeding means includes means for delivering the sheets to the conveyor in such positions that the creases of successive sheets are in line with the deepmost portion of the endless groove.

In accordance with another feature of the invention, the folding member is preferably one component of a composite folding means including a row of rotary roller-shaped folding members having annular peripheral portions which taper radially outwardly and each of which extends into the groove of the endless conveyor. The taper of the peripheral portions of folding members preferably increases from folding member to folding member, as considered in the direction of movement of the conveyor in the region between the first and second holder means. The taper of the peripheral portion of the last rotary folding member preferably equals or slightly exceeds the angle between the mutually inclined surfaces of the conveyor which flank the V-shaped groove. The mounting of the back support and of the row of folding members is preferably such that the extent to which successive folding members penetrate into the groove increases, as considered in the direction of travel of sheets between the conveyor and the folding members.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic partly elevational and partly sectional view of a folding apparatus which embodies the invention;

FIG. 2 is an enlarged fragmentary transverse vertical sectional view as seen in the direction of arrows from the line II—II of FIG. 1; and FIG. 3 is a view similar to FIG. 2 of a detail as seen in the direction of arrows from the line III—III of FIG. 1.

DESCRIPTION OF THE PREFERRED EMBODIMENTS

The apparatus which is shown in FIGS. 1 and 2 comprises a magazine 2 for a stack of unfolded and uncreased paper sheets 1. A feeding mechanism including a single suction head 3 or a row of two or more aligned suction heads is provided to withdraw successive lowermost sheets 1 from the magazine 2 and to transport such sheets along an arcuate path between the neighboring reaches of a set of intermediate feeding conveyors 10 here shown as endless belt conveyors. The feeding mechanism further comprises a rotary drum-shaped carrier 5 which is driven to rotate in the direction indicated by arrow and includes an annular central portion 5*a* consisting of rubber or other suitable elastomeric material. The periphery of the carrier 5 is provided with grippers or claws 4 which are caused to open when the suction head or heads 3 deliver the leader of a sheet 1 and to thereupon close so that the sheet is withdrawn from the magazine 2 and overlies the periphery of the carrier 5 including the annular central portion 5*a*. The carrier 5 transports successive sheets 1 past a scoring or creasing wheel 6 mounted on a lever 7 which is fulcrumed (at 8) in the frame F of the apparatus and is biased counterclockwise (as viewed in FIG. 1) by one or more springs 9. The member 6 is an idler wheel and cooperates with the annular central portion 5*a* to provide successive sheets 1 with creases in order to facilitate subsequent folding of such sheets. The paths of the jaws 4 flank the annular central portion 5*a* of the carrier 5 and the conveyor 10. The jaws 4 open when the leader of a sheet 1 is moved between the neighboring reaches of the conveyors 10.

The sheet-engaging reaches of the intermediate conveyors 10 travel in the directions indicated by arrows 10*a* and deliver successive sheets (each of which is provided with a crease) into the inlet 11 of a folding unit 12 which is constructed and assembled in accordance with one feature of the present invention. The folding unit 12 comprises an endless conveyor 13 which is a belt consisting of elastomeric material and having an outer side 13*a* provided with a V-shaped endless groove 17 shown in FIG. 2. The conveyor 13 is trained over pulleys 14, 15 and 16. At least one of the pulleys (e.g., the pulley 16) is driven by the main prime mover of the apparatus to advance the conveyor 13 in the direction indicated by arrow 13*d*. The lower reach 13A of the conveyor (between the pulleys 14 and 16) is straight and substantially horizontal. The inner side 13*b* of the lower reach 13A is propped by a back support including a series of idler rollers 18 mounted on shafts 19 secured to a plate-like holder 20 which is adjustable in the frame F in directions toward and away from the lower reach 13A. The means for adjustably supporting the holder 20 comprises two parallel horizontal rods 21 which extend at right angles to the plane of FIG. 1 and whose end portions pass through elongated vertical slots 24 provided in two upright side walls 22, 23 of the frame F. The outer end portions of the rods 21 are threaded and mesh with wing nuts 25 which can be rotated to release the rods for movement of the holder 20 toward or away from the lower reach 13A or to fixedly retain the holder in a selected position. Adjustments of the holder 20 and rollers 18 are desirable in order to properly set the apparatus for folding of relatively thin or thick sheets and/or to account for differences between other characteristics of successive batches of sheets.

The folding unit 12 further comprises a second holder 26 which is mounted in the frame F at a level below the lower reach 13A of the endless conveyor 13 and supports a row of aligned idler rollers 27 or 27′ each of which constitutes a rotary male folding member. The annular peripheral portions 27A of the rollers 27 taper radially outwardly so that their (wedge-like) shape conforms to the outline of the V-shaped groove 17 in the outer side 13*a* of the conveyor 13. The angle between the side faces 27B, 27D of the peripheral portions 27A of the rollers 27 can equal or exceed the angle between the mutually inclined surfaces 17A, 17B flanking the groove 17 because the material of the conveyor 13 is elastic, i.e., such material can be deformed during travel of successive increments of the conveyor 13 past the rollers 27. It is clear that the entire conveyor 13 need not be elastic, i.e., it suffices if that portion of the conveyor 13 which is adjacent to the surfaces 17A, 17B consists of elastomeric material.

The adjustment of the upper holder 20 is preferably such that the folding action of the lower reach 13A and of the rollers 27 increases in the direction (arrow 13*d*) of travel of creased sheets 1 through the folding unit 12. In other words, the penetration of the peripheral portion 27A of the rightmost roller 27 into the groove 17 is less pronounced than the penetration of the peripheral portion of each next-following roller 27. The leftmost roller 27 of FIG. 1 preferably extends all the way into the deepmost portion of the groove 17. This results in gradual folding of successive sheets 1 during travel through the unit 12. The folded sheets which leave the unit 12 via outlet 28 are (or may be) introduced into a final folding unit whose construction forms no part of the invention. Such final folding unit may comprise a pair of driven rolls which engage the outer sides of successive folded sheets 1 at the opposite sides of the creases to complete the folding action.

In accordance with a presently preferred embodiment of the invention, the angle between the side faces 27B, 27D decreases from roller to roller 27, as considered in the direction indicated by arrow 13*d*. Thus, the angle is smallest on the roller 27 which is nearest to the outlet 28 and such angle is greatest on the roller 27 which is nearest to the inlet 11. The angle between the side faces 27B, 27D on the last (leftmost) roller 27 of FIG. 1 preferably equals or is even less than the angle between the surfaces 17A, 17B flanking the groove 17 of the conveyor 13. Such selection of rollers 27 also contributes to gradual and hence more accurately reproducible folding of sheets 1 during transport through the unit 12. In fact, by employing a set of folding rollers 27, 27′ which are configurated in the just outlined manner, the folding of sheets 1 can be completed in the unit 12, i.e., the aforediscussed squeezing rollers which form part of final folding units in conventional apparatus can be dispensed with. FIG. 3 illustrates the cooperation of the roller 27', having an angle of taper greater than that of the roller 27 and located upstream of the latter, with the outer side of the conveyor 13, the groove 17 provided in the latter, and the sheet being folded which is confined between the roller 27' and the conveyor 13.

It has been found that the rollers 18 of the back support reduce the likelihood of uncontrolled shifting of sheets 1 during transport between the lower reach 13A and the folding rollers 27. This is due to the fact that the rollers 18 prevent vibration of the conveyor 13, even if the pulley 16 is driven at a high speed. The beneficial effect of rollers 18 upon the sheets in the region between the inlet 11 and outlet 28 is enhanced by the action of folding rollers 27 because the rollers 27 are not mounted on a conveyor and also because the taper of peripheral portions 27A of rollers 27 preferably increases in a direction toward the outlet 28.

As mentioned above, the holder 20 will be adjusted in order to account for changes in the thickness of successively treated batches of sheets, to account for other characteristics (such as stiffness and surface finish) of the sheets, and to insure that the extent to which the peripheral portions 27A of successive rollers 27 penetrate into the groove 17 increases in the direction indicated by arrow 13*d*.

It is also within the purview of the invention to provide means for driving the rollers 27 at a peripheral speed which corresponds to the speed of lengthwise movement of the lower reach 13A. The means for driving the rollers 27 may include a train of mating gears some of which are mounted on the shafts 27*a* of the rollers 27 and one of which receives torque from the main prime mover of the folding apparatus. It is further possible to provide means for adjustably mounting the lower holder 26 in the frame F, either in addition to or instead of adjustable mounting of the upper holder 20.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In an apparatus for folding sheets which consist of paper or the like, the combination of an elongated endless conveyor advancing in a trajectory and having an inner side, an outer side, and two inclined surfaces bounding a substantially V-shaped endless longitudinal groove of a uniform cross section in said outer side and enclosing a substantially constant angle with one another over the entire length of the conveyor; a back support adjacent to a portion of said trajectory at said inner side; means for feeding sheets seriatim to said outer side for joint advancement therewith along said trajectory portion; and means for forcing portions of the sheets to various extents into said groove, including at least two surface sections extending into and tapering toward said groove opposite said back support at an angle which changes along said trajectory portion.

2. The combination of claim 1, further comprising means for driving said conveyor in a predetermined direction, said trajectory portion including an elongated straight reach which is outwardly adjacent to said back support and said forcing means including a row of rotary folding members adjacent to said reach and disposed one behind the other, as considered in said direction.

3. The combination of claim 2, wherein said angle of taper of said surface sections increases from rotary member to rotary member, as considered in said direction.

4. The combination of claim 3, wherein said conveyor has two mutually inclined surfaces flanking said groove and the angle between said surfaces at most equals said angle of taper of the surface sections of the last of said rotary members, as considered in said direction.

5. The combination of claim 2, further comprising holder means for supporting said back support and said rotary members in such positions that the extent to which said surface sections of successive rotary members penetrate into said groove increases, as considered in said direction.

6. The combination of claim 1, further comprising means for creasing the sheets ahead of said conveyor, said feeding means including means for delivering successive sheets to said conveyor in such positions that the creases are at least substantially in line with the deepmost portion of said groove.

* * * * *